US007434341B2

(12) United States Patent
Brinkman et al.

(10) Patent No.: US 7,434,341 B2
(45) Date of Patent: Oct. 14, 2008

(54) CURVED BACK LABEL HOLDER FOR A SHELF

(75) Inventors: Michael Brinkman, Belvidere, IL (US); Craig Zadak, Roscoe, IL (US); Kirk Lewis, Lee's Summit, MO (US)

(73) Assignee: Southern Imperial, Inc., Rockford, IL (US)

( * ) Notice: Subject to any disclaimer, the term of this patent is extended or adjusted under 35 U.S.C. 154(b) by 319 days.

(21) Appl. No.: 11/235,566

(22) Filed: Sep. 26, 2005

(65) Prior Publication Data

US 2006/0086027 A1 Apr. 27, 2006

Related U.S. Application Data

(63) Continuation-in-part of application No. 10/458,291, filed on Jun. 10, 2003, now Pat. No. 6,971,201.

(51) Int. Cl.
*G09F 3/18* (2006.01)

(52) U.S. Cl. ..... 40/642.02; 40/651; 248/231.81

(58) Field of Classification Search ..... 40/642.02, 40/649, 651, 658, 661, 661.03; 248/231.81, 248/220.22; 211/57.1, 59.1
See application file for complete search history.

(56) References Cited

U.S. PATENT DOCUMENTS

| | | | | |
|---|---|---|---|---|
| D189,147 | S | 11/1960 | Hinchcliffe | |
| 3,164,354 | A | 1/1965 | Mordock | |
| 3,168,954 | A | 2/1965 | Herrmann | |
| D209,071 | S | 10/1967 | Koch | |
| D291,097 | S | 7/1987 | Dalbey et al. | |
| 5,044,104 | A | 9/1991 | Hopperdietzel | |
| 5,419,066 | A | 5/1995 | Harnois et al. | |
| 5,899,011 | A | 5/1999 | Brinkman | |
| 6,105,295 | A | 8/2000 | Brinkman et al. | |
| 6,226,910 | B1 | 5/2001 | Ireland | |
| D443,311 | S | 6/2001 | Wildrick | |
| 6,263,603 | B1 | 7/2001 | Wildrick | |
| D453,535 | S | 2/2002 | Wingerei et al. | |
| D454,163 | S | 3/2002 | Nagel | |
| 6,357,154 | B1 | 3/2002 | Pfendler et al. | |
| 6,470,613 | B1 | 10/2002 | Wildrick | |
| 6,688,567 | B2 | 2/2004 | Fast et al. | |
| 6,971,201 | B2 | 12/2005 | Brinkman et al. | |
| D531,227 | S * | 10/2006 | Mueller et al. | D20/44 |
| D546,892 | S * | 7/2007 | Bruegmann | D20/44 |

OTHER PUBLICATIONS

Andrew J. Heinisch, Disclosure Statement for Information Disclosure Statement, Jan. 14, 2008, 1 page.

* cited by examiner

*Primary Examiner*—William L. Miller
(74) *Attorney, Agent, or Firm*—Reinhart Boerner Van Deuren P.C.

(57) ABSTRACT

A label holder includes at least one panel having a rib. The at least one panel is constructed to have a resilient rearward curvature that flexes to flatten against a shelf. The label holder further includes a retainer structure extending rearwardly from the at least one panel. The retainer structure includes a clip configured to resiliently clamp the label holder to the shelf. When mounted to the shelf, the rib engages the shelf and causes flexure of the resilient rearward curvature of the front panel, forms a lid for a cavity that houses a label, and biases the clip against a back surface of the angled front panel to provide secure attachment of the label holder to the shelf.

18 Claims, 6 Drawing Sheets

CURVED BACK LABEL HOLDER FOR A SHELF

CROSS-REFERENCE TO RELATED PATENT APPLICATIONS

This patent application is a continuation-in-part of U.S patent application Ser. No. 10/458,291, now U.S. Pat. No. 6,971,201, filed Jun. 10, 2003.

FIELD OF THE INVENTION

This invention pertains to the field of label holders for merchandise displays, and in particular, to label holders for mounting onto a shelf.

BACKGROUND OF THE INVENTION

The present invention is related to label holders that can be made from extruded plastic with a clear front panel that forms, in combination with a main panel and a common bottom edge, a cavity for retaining paper labels therebetween. Typically, such label holders are installed along the front edge of a display shelf. Conventional label holders are typically attached to the bottom edge of a display shelf via a full crown ridge integrally attached to the shelf, and generally project below the bottom edge of a shelf and are susceptible to removal if a product snags the label holder because the label holder is too loosely attached to the shelf.

BRIEF SUMMARY OF THE INVENTION

In light of the above, it is a general aim of the present invention to provide a label holder that resiliently clamps to a shelf such that the label holder is not susceptible to removal. In an embodiment, the label holder includes a front panel, a back panel connected to the front panel with a common bottom edge, said front panel and the back panel forming a cavity for labels to be inserted therein. The back panel is constructed to have a resilient rearward curvature that flexes to flatten against the shelf.

The label holder further includes a retainer structure extending rearwardly from the back panel. The retainer structure includes a spring clip configured to resiliently clamp the label holder to the shelf. The label holder is configured such that when mounted to the shelf, the shelf in combination with said retainer structure causes the flexure of said resilient rearward curvature to provide secure attachment of said label holder to the shelf.

The spring clip provides resilient clamping onto the shelf such that the spring clip causes the back panel to resiliently flex against the shelf and the spring clip clamps the shelf between the spring clip and the back panel. Spring clip also clamps the shelf between a bottom surface of the label holder and the spring clip.

The label holder can also be configured to include a flange that projects forwardly from the common bottom edge and bends upwardly towards the front panel. In an embodiment, the label holder also includes a protective flange configured to extend forwardly over the front panel.

In one embodiment, the front panel and the back panel are configured to have approximately a 1° separation prior to attachment to the shelf, the separation narrowing at an upper portion such that the front panel meets or nearly meets the back panel.

One embodiment is directed to a label holder mounted on a shelf. The shelf has a top surface, a flat angled panel and a lower support flange and the label holder. In the embodiment, the label holder includes a retainer structure that extends rearwardly from a back panel. The retainer structure includes a spring clip configured to resiliently clamp the label holder to the shelf. The retainer structure and the back panel resiliently flex to the shelf, the mounting to the shelf causing the resilient rearward curvature to flatten and grip the flat angled panel.

Another embodiment is directed to a label holder that has at least one panel and a rib and is mounted on a shelf. Like before, the shelf has a top surface, a flat angled panel and a lower support flange. In this particular embodiment, the rib engages the flat angled panel, assists in forming a cavity for a label, causes the at least one panel to flatten toward the flat angled panel, and also biases a spring clip in the retainer structure against the flat angled panel.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
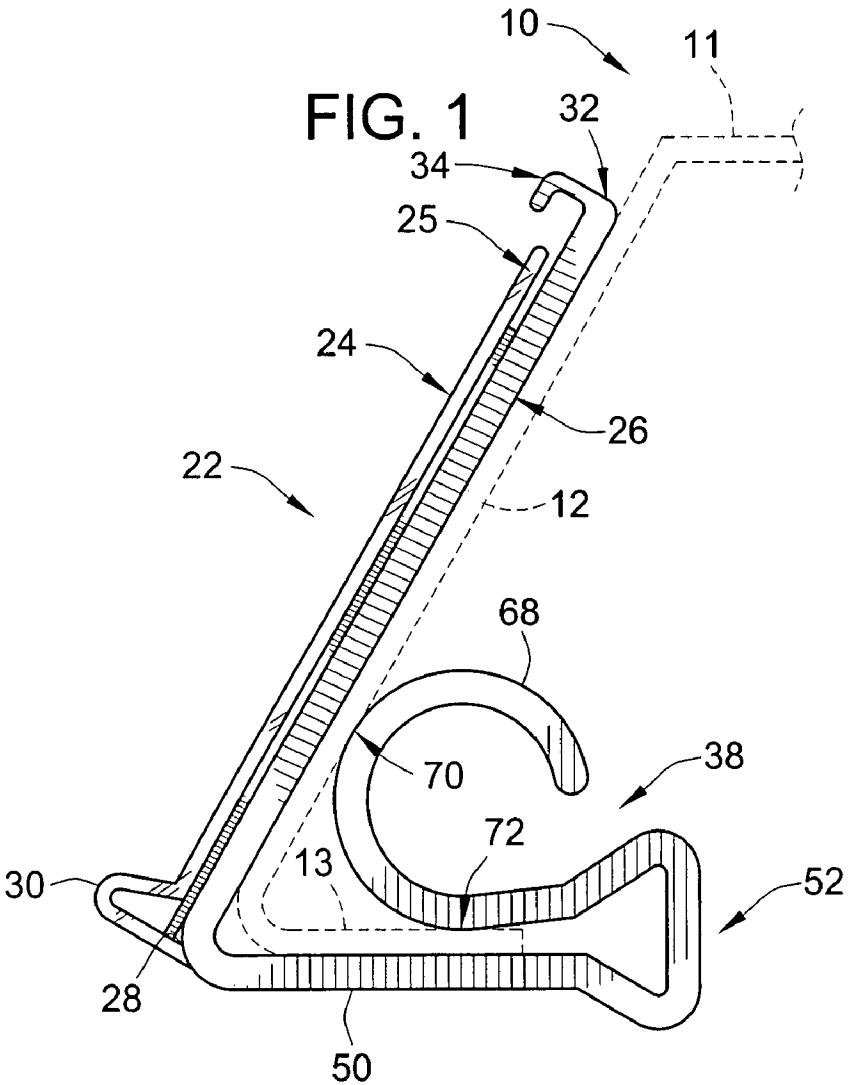
FIG. 1 is side view of a label holder installed in a shelf structure shown in dashed lines in accordance with an embodiment of the present invention.

Referring now to the figures, FIG. 1 illustrates a shelf structure 10 having a top surface 11 and a flat angled front panel 12 and a lower support flange 13. Typically, shelf structure 10 is constructed of a metal and of a flat faced type such as that referred to as Darling or Syndicate type flat-faced shelving. Flat top surface 11 can be structured to hold products such as would be appropriate for retail display.

Also shown in FIG. 1 is a label holder, generally designated by the reference number 22. Label holder 22 can be extruded of a plastic material, such as polyvinyl chloride, Butryrate, Provista or acrylonitrile butadiene styrene (ABS), and can be either translucent or partially translucent, for example, as in having a co-extruded opaque back portion. In another embodiment, the label holder can be opaque or partially opaque. The opacity determines whether the label holder is appropriate for using adhesive and non-adhesive labels. A translucent front enables non-adhesive labels, however, an opaque label holder can be used with adhesive labels. The label holder 22 includes a front panel 24 and a back panel 26 that are joined along a common bottom edge 28. Label holder 22 further includes a flange 30 projecting forwardly from common bottom edge 28 and bending upward to the front panel 24 to facilitate a scanning wand or the like for scanning labels inserted into label holder 22. The back panel 26 extends upwardly and bends forwardly to form a top portion 32 forming a protective flange 34 that extends forwardly over front panel 24 back portion 26 bottom portion.

Label holder 22 further includes a flat bottom surface 50 extending rearwardly from the back panel 26. Flat bottom surface 50 is part of retainer structure 38. Retainer structure 38 also includes a forwardly-facing, spring clip 68 connected to a rearward end 52 with an opening at an end of spring clip 68 that provides resilient clamping onto shelf 10 at two clamp points identified by reference numbers 70 and 72. The area between the back panel 26, bottom surface 50 and spring clip 68 forms gripping channel including clamp points 70 and 72.

Figure 2:
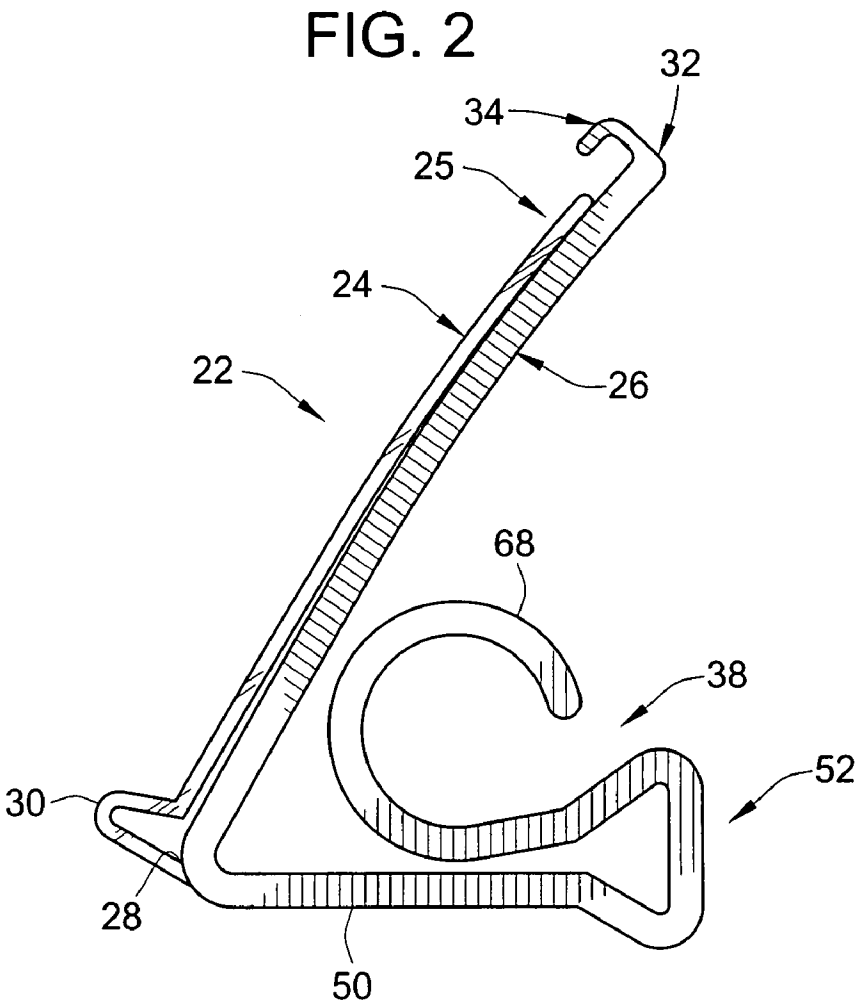
FIG. 2 is a side view of a label holder outside of the shelf structure of FIG. 1 illustrating features in accordance with an embodiment of the present invention.

Referring now to FIG. 2, an unattached label holder 22 is illustrated in a cross-section view. As shown, label holder 22, when not mounted to shelf 10, and in a relaxed position, back panel 26 has a resilient curve such that after mounting to shelf 10, as shown back panel 26 and angled front panel 12 and angled front panel 24 meets back panel 26 at top area 25. The resilient curve is proportionate to the thickness of back panel 26. Thus, if back panel 26 is thinner, the resilient curve would be greater to maximize the strength of attachment. Conversely, if back panel 26 is thicker, the resilient curve would be less to achieve the same strength. Thus, the curvature can fluctuate depending on design requirements for the thickness of back panel 26. In one example, the radius on back panel 26 can be approximately 3.5 inches and the back panel thickness could be 0.50 inches. If the back panel, in an alternate embodiment were 0.03 inches thick the radius could be approximately between 3.25 inches and 3 inches.

Front panel 24 also has a resilient curve. Back panel 26 and front panel 24 together each flex when installed onto shelf 10 to cause back panel 26 to be flush with angled front panel 12 of shelf 10. The amount by which the back panel 26 and front panel 24 form a resilient rearward curvature depends on design requirements. Depending on the type of plastic used for the label holder, and the flexure thereof, a curvature can be greater or less than the curvature shown and be within the scope of the present disclosure. In one embodiment, the curvature and flexure is enough to form a seal when installed with angled front panel 12.

Front panel 24 can be configured to nearly match the curve of back panel 26 such that flange 30 of front panel 26 extends outwardly by about a 1° separation between back panel 26 and front panel 24. The separation gradually narrows such that an upper portion 25 of front panel 24 meets or nearly meets back panel 26 when not installed. Thus, even though back panel 26 arcs away from front panel 24, front panel 24 grips back panel 26 at upper portion 25 when not mounted to shelf 10. Between front panel 24 and back panel 26 a cavity suitable for receiving labels is formed with the bottom portion 28 of the cavity being wider than the top portion of the cavity when not mounted to shelf 10. Referring back to FIG. 1, after mounting to shelf 10, as shown back panel 26 grips the surface of angled front panel 12 and angled front panel 24 lies approximately parallel to back panel 26 at top area 25 when installed.

Figure 3:
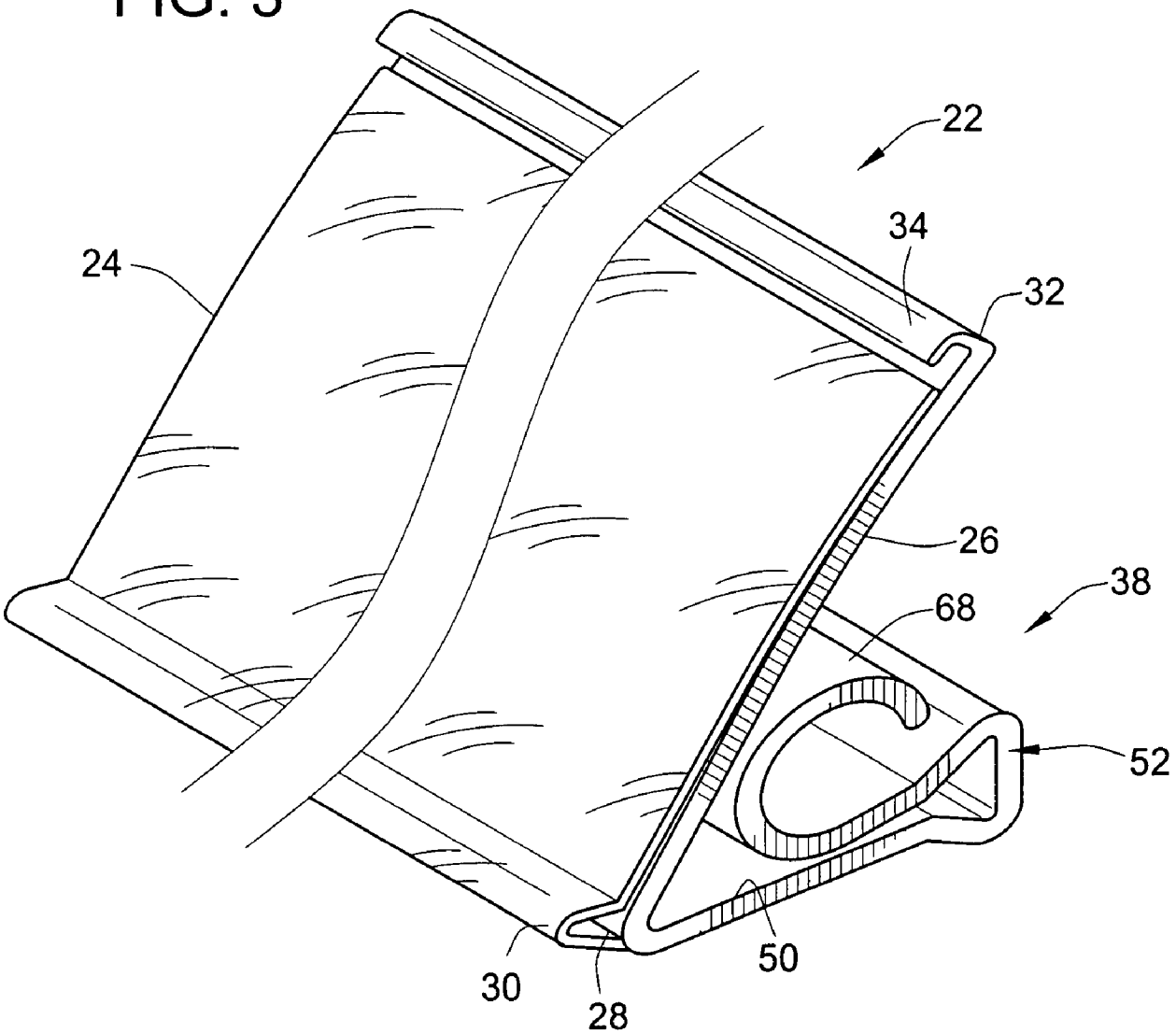
FIG. 3 is a perspective view of the label holder of FIG. 2 in accordance with an embodiment of the present invention.

Referring now to FIG. 3, a perspective broken view of label holder 22 is shown illustrating that label holder 22 can be of any suitable length appropriate for any length shelf 10. As one skilled in the art will appreciate, the size of label holder 22 can be adjusted for different sized shelves 10. In a typical embodiment, top 32 of label holder 22 does not project above the top of shelf 10 thereby enabling customers to easily remove products from a display above label holder 22. Also, the height of label holder 22 can be adjusted for different sized angled front panels 12. Typically, however, the height of label holder 22, at least in some embodiments, can be approximately between 1" and 1½" or approximately between 3 and 4 inches.

The label holder in embodiments herein, represents a significant improvement over known label holders in that now a reliable label holder can be attached to three-sided shelves such as shelf 10 in a secure manner. Referring now to FIG. 1, to mount label holder 22 onto shelf 10, spring clip 68 and back panel 26 resiliently flex around shelf 10 at lower support flange 13. Retainer structure 38, with spring clip 68, and rearward end 52, can function as a spring to provide resilient attachment to shelf 10. After attaching label holder 22 to shelf 10, label holder 22 grips angled panel 12 and lower support flange 13 by having spring clip 68 grip both the angled front panel 12 and lower support flange 13 at the same time. When in the fully mounted position, back panel 26 lies flush with angle front panel 12; and flat bottom surface 50 lies flush with lower support flange 13. During mounting, retainer structure 38, including spring clip 68, bottom surface 50 and rearward end 52 resiliently expand around lower support flange 13 of shelf structure 10. Specifically, one method of attaching label holder 22 includes flexing retainer structure 38 around lower flange 13 of shelf structure 10, and allowing spring clip 68 to then contact angled panel 12 of shelf structure 10 from the rear thereof, while back panel 26 also meets the forward face of angled panel 12. As back panel 26 flexes to meet shelf structure 10, the curvature of back panel 26 flattens against the shelf as retainer structure 38, and more particularly, spring clip 68 grips the shelf.

Figure 4:
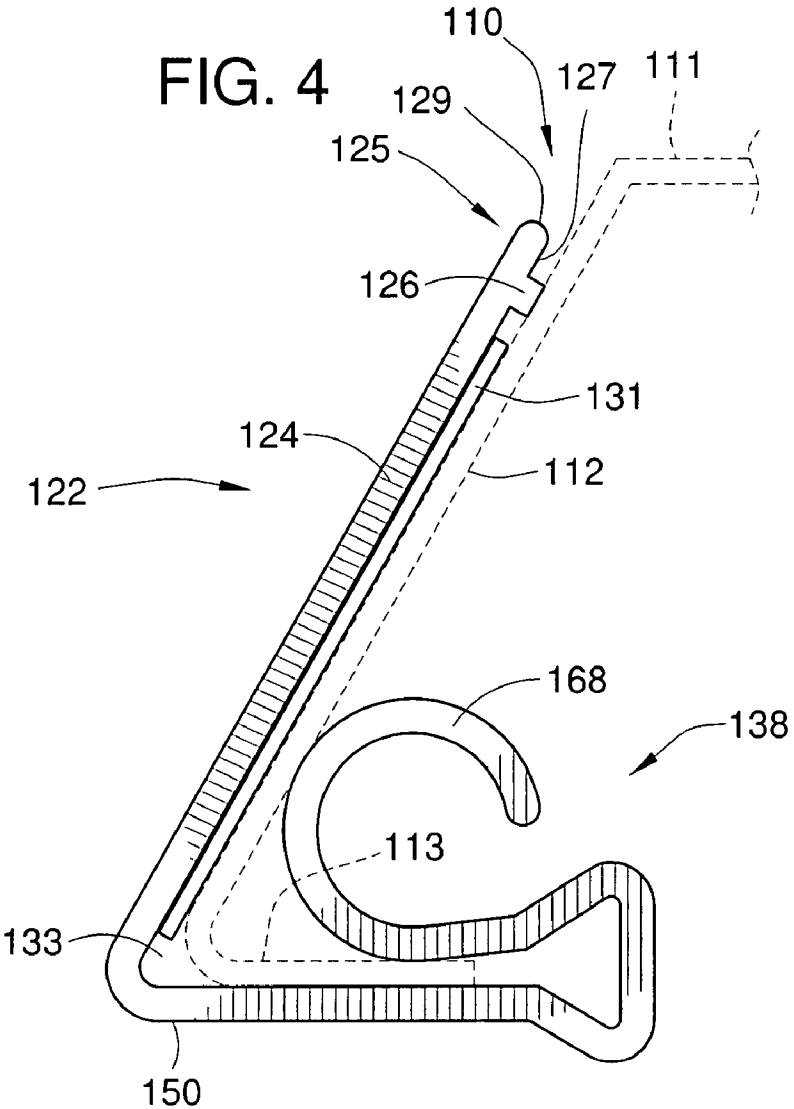
FIG. 4 is a side view of a label holder installed in a shelf structure shown in dashed lines in accordance with another embodiment of the present invention.

Referring to FIG. 4, a shelf structure 110 having a top surface 111 and a flat angled front panel 112 and a lower support flange 113. Typically, shelf structure 110 is constructed of a metal and of a flat faced type such as that referred to as Darling or Syndicate type flat-faced shelving. Flat top surface 111 can be structured to hold products such as would be appropriate for retail display.

Figure 5:
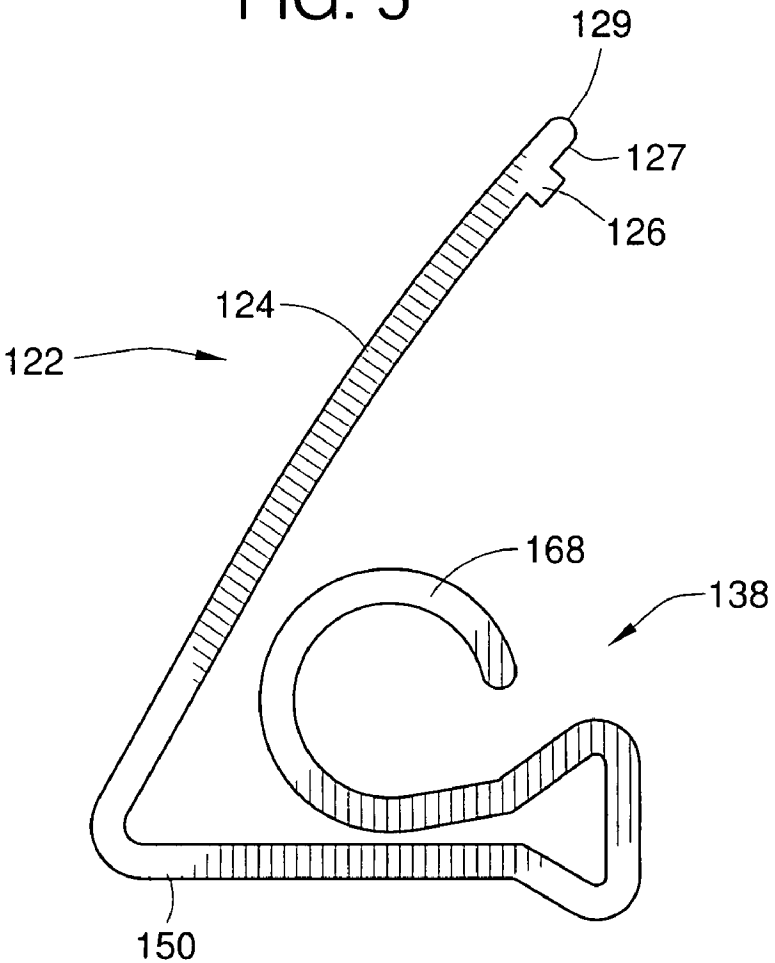
FIG. 5 is a side view of label holder outside of the shelf structure of FIG. 4 illustrating features in accordance with an embodiment of the present invention.

A label holder, generally designated by the reference number 122, is shown in both FIGS. 4 and 5. In FIG. 4, the label holder 122 is shown coupled with the shelf structure 110 and in a biased state. In contrast, the label holder is shown in FIG. 5 disengaged from the shelf structure 10 and in a relaxed state. The label holder 122 depicted in each of FIGS. 4 and 5 has many of the same or similar features as label holder 22 illustrated in FIG. 1. Therefore, only those features and/or components that distinguish the label holder 122 from the label holder 22 will be discussed in detail.

Figure 6:
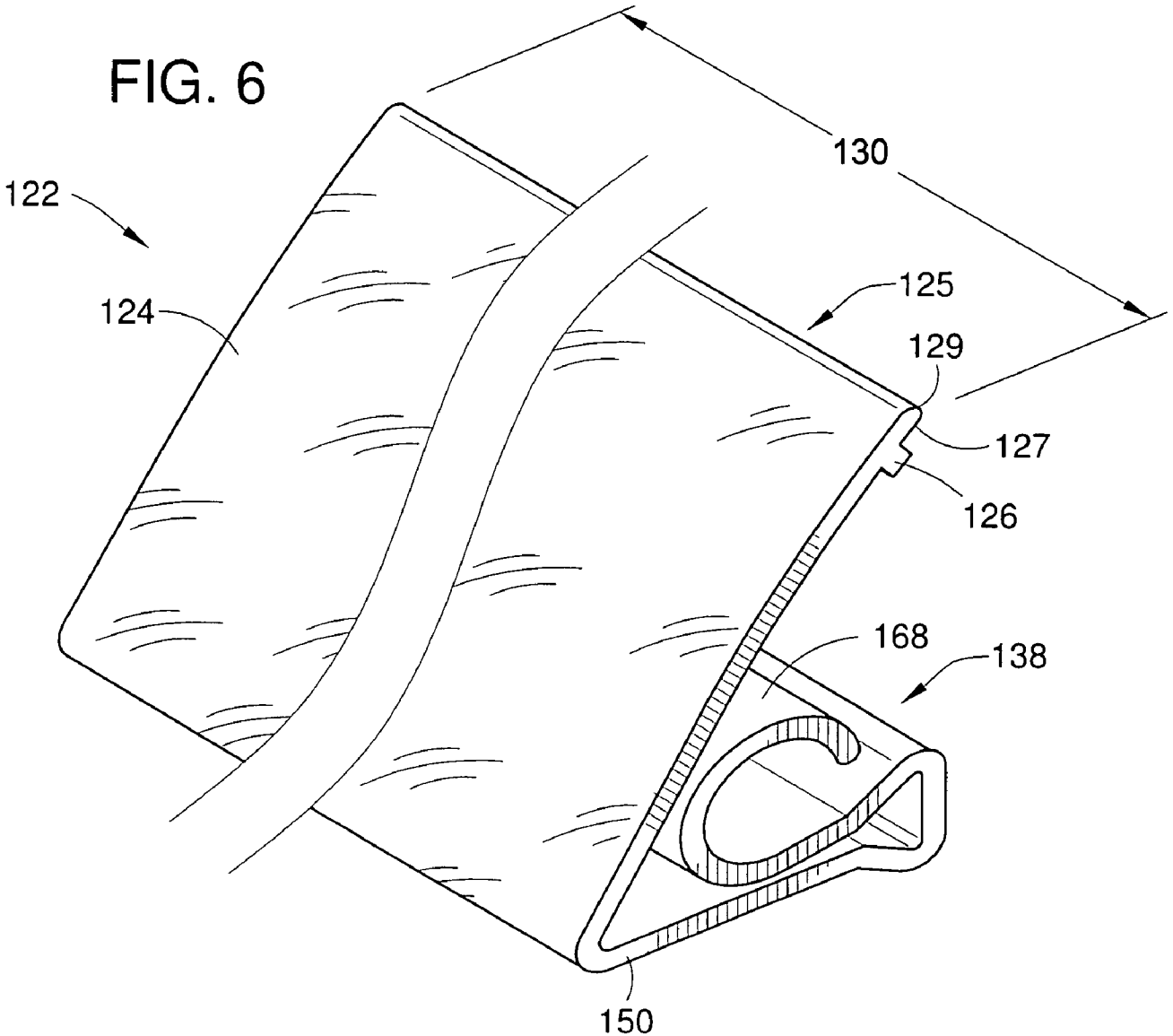
FIG. 6 is a perspective view of the label holder of FIG. 5 in accordance with an embodiment of the present invention.
Figure 7:
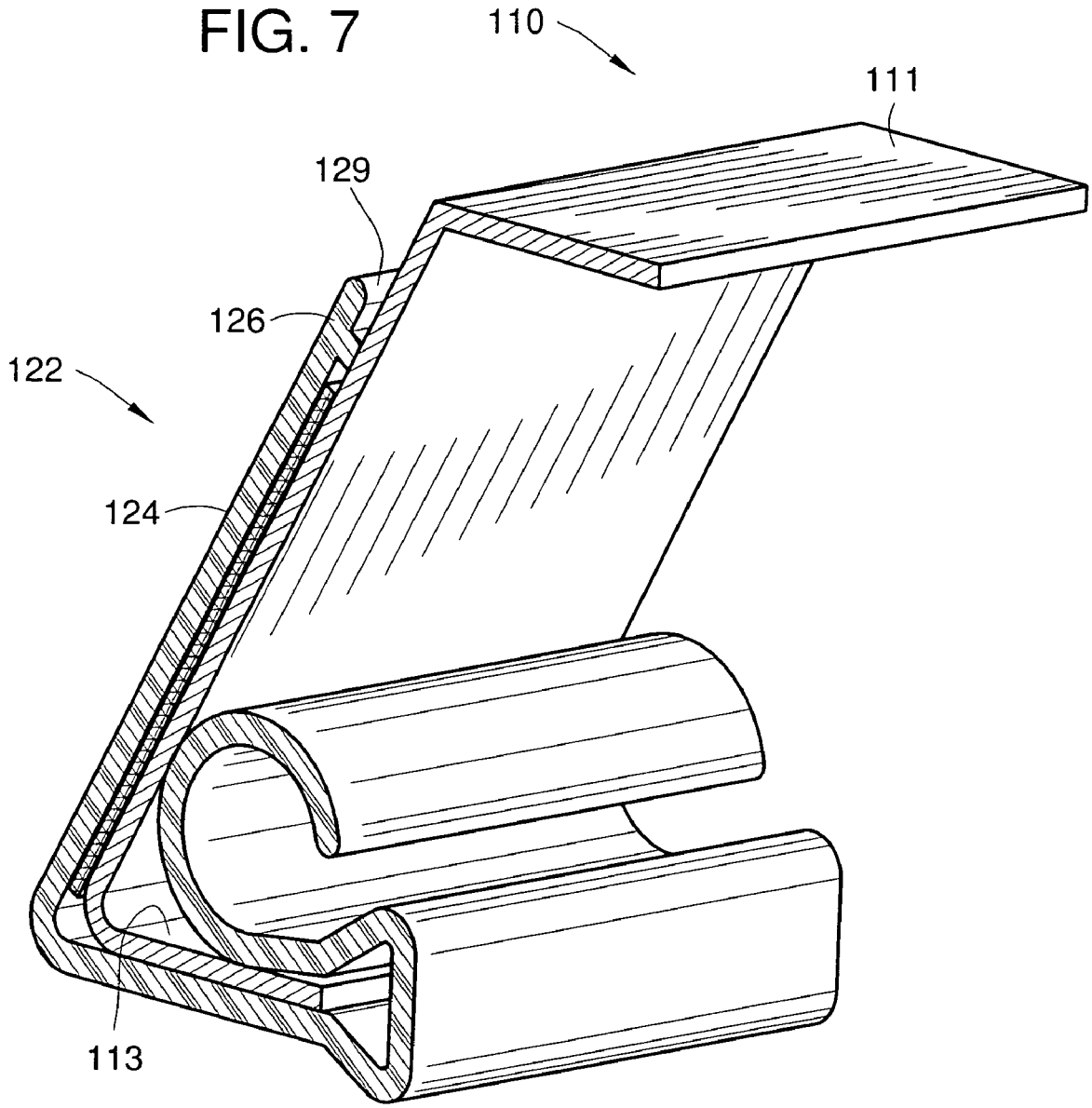
FIG. 7 is a perspective view of the label holder of FIG. 4 installed in the shelf structure accordance with an embodiment of the present invention.

As illustrated in FIG. 4, the label holder 122 includes a panel 124 that has a top area 125 and a rear surface 127. The top area 125 includes a top and terminating end 129. Proximate the top and terminating end 129 of the top area 125, and on the rear surface 127, the panel 124 optionally includes a rib 126. As best shown in FIG. 6, the rib 126 extends along an entire lateral span 130 of the label holder 122. Additionally, the rib 126 is generally parallel with the lower support flange 113 as best shown in FIG. 7.

Referring back to FIGS. 4 and 5, the rib 126 performs several beneficial functions. First, the rib 126 engages the front panel 112 of the shelf structure 110 prior to rest of the panel 124. In fact, as shown in FIG. 4, the rib 126 is the only portion of the panel 124 that contacts the front panel 112. Since the rib 126 is disposed at the terminating end 129 of the panel 124, and since the rib is the first portion of the panel that contacts the front panel 112, the rib may be used to bias the panel from the relaxed state (FIG. 5) to the biased state (FIG. 4).

As the transition from the relaxed state to the biased state occurs, the flexure of the panel 124 from a curved panel (FIG. 5) to generally planar, straight, and/or flat panel (FIG. 4) promotes and/or causes clip 168 of the retainer structure 138 to engage with the front panel 112 as shown in FIG. 4. Therefore, in this embodiment, the rib 126 ensures that the clip 168 positively and forcibly engages the front panel 112 when the label holder 122 is clamped to a shelf structure 110.

As shown in FIG. 4, the panel 124, the front panel 112, the lower support flange 113, and the flat bottom surface 150 form a cavity 133 for a label 131. Thus, unlike the prior embodiment, the label cavity is formed between the shelf and the label holder. Thus, this embodiment shows that a label holder having a single panel may be used. When the label 131 is disposed within the cavity 133, the rib 126 acts as a "lid" and/or "stop" to inhibit and/or prevent the label from being unintentionally removed from the cavity. Even so, since the panel 124 is flexible, if the label 131 needs to be removed, the panel can simply be biased away from the front panel 112 until the rib 126 and the front panel disengage and form an opening of the cavity 133 proximate the top area 125 of the panel. The label 131 can then be easily slid and/or pulled upwardly and out of the cavity for removal, replacement, cleaning, repositioning, and the like.

As the previous paragraphs demonstrate, the rib 126 simultaneously performs at least three beneficial functions. The rib 126 initiates and accomplishes contact with the front panel 112 when the label holder 122 is snapped into place on a shelf structure 110, assists in forming a cavity 133 with other components, and ensures that the clip 168 engages and remains in contact with the front panel. In this embodiment, the means for deforming the at least one panel when engaged with the shelf front include one or more of the following: the curved profile of the front panel 124; and/or the angle or configuration of the front panel 124 relative to the rearward extending flange 150; and/or the rib 126.

Figure 8:
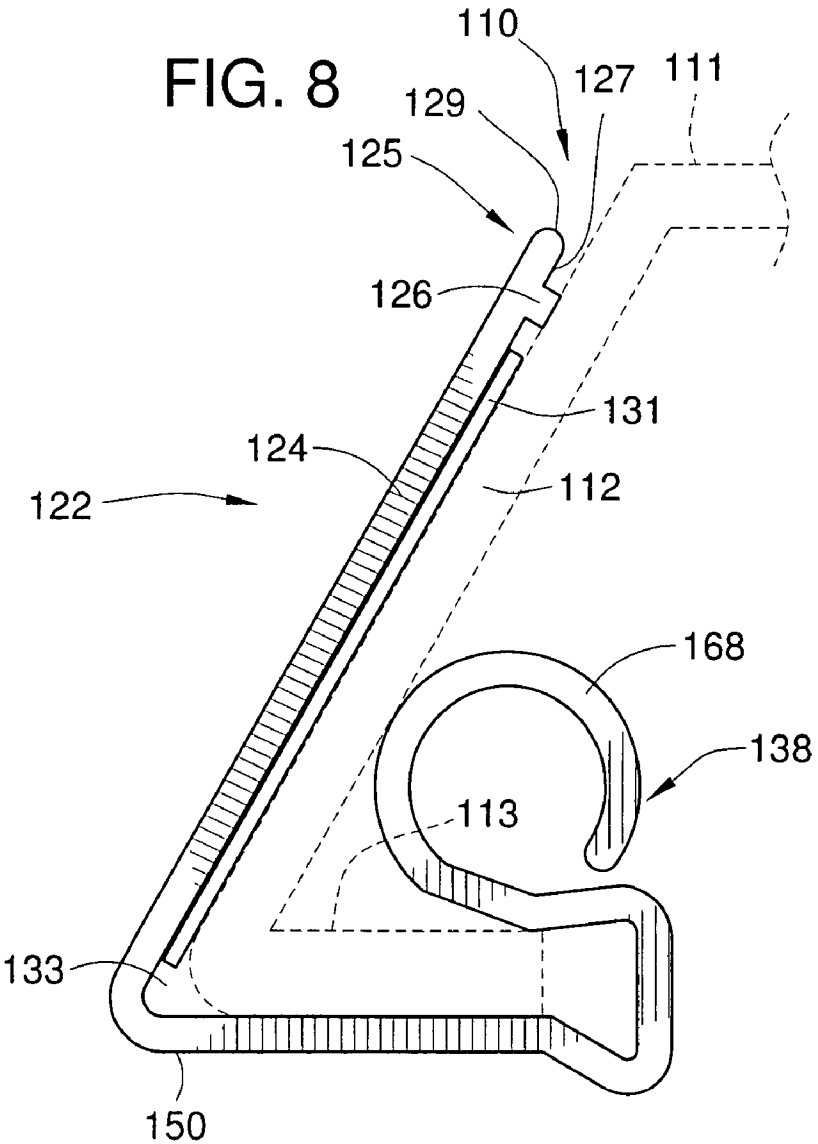
FIG. 8 is a side view of a label holder installed in an enlarged shelf structure shown in dashed lines in accordance with another embodiment of the present invention.

Referring to FIG. 8, the label holder 122 is shown engaged with an enlarged shelf structure 110 (as compared to shelf structure 110 of FIG. 4). Since the retaining structure 138 is formed from a flexible material, the structure expands to accommodate the larger shelf structure 110; such as a base deck for the example. In particular, the retaining structure 138 further opens to engulf the enlarged lower support flange 113 while the spring clip 168 is further displaced away from the panel 124 to adjust to the enlarged front panel 212. As will be appreciated by those skilled in the art, the flexibility of the label holder 122 permits the engagement with shelf structures 110 having a variety of sizes. Other than these distinctions, as illustrated, this embodiments is like the previous embodiments.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention as illustrated, in various embodiments and with various modifications as are suited to the particular use contemplated. All such modifications and variations are within the scope of the invention as determined by the appended claims when interpreted in accordance with the breadth to which they are fairly, legally, and equitably entitled.

All references, including publications, patent applications, and patents cited herein are hereby incorporated by reference to the same extent as if each reference were individually and specifically indicated to be incorporated by reference and were set forth in its entirely herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A retail display apparatus comprising in combination:

(a) a shelf comprising:

a top panel extending horizontally;

a front angled panel having a flat front surface extending downwardly and forwardly from the top panel; and a lower support flange extending horizontally rearwardly from the front angled panel in vertical spaced relation to the top panel;

(b) a label holder formed of resilient plastic material, the label holder comprising:

at least one panel; and a retainer structure integrally connected to the at least one panel, the retainer structure including a bottom flange extending rearwardly relative to the at least one panel, the bottom flange carrying a clip;

wherein the label holder has a first relaxed state when the label holder is not mounted to the shelf and a second biased state when the label holder is mounted to the shelf, the at least one panel defining a curved surface extending through a middle portion of the at least one panel between top and bottom portions thereof when in the first relaxed state, the bottom flange extending underneath the lower support flange, the clip engaging at least one of the lower support flange and the front angled panel, and the at least one panel deforming such that the at least one panel engages and biases against the flat front surface to thereby secure, in cooperation with the clip, the label holder to the shelf in the second biased state.

2. The retail display apparatus of claim 1, wherein a rear surface of the at least one panel includes a rib.

3. The retail display apparatus of claim 2, wherein the rib is disposed proximate a top and terminating end of the at least one panel.

4. The retail display apparatus of claim 2, wherein the rib extends along an entire lateral span of the rear surface and is generally parallel with the lower support flange.

5. The retail display apparatus of claim 2, wherein the rib, the at least one panel, and the flat front surface of the front angle panel define a cavity adapted to house a label.

6. The retail display apparatus of claim 2, wherein the rib of the at least one panel assists in deforming the at least one panel.

7. The retail display apparatus of claim 1, wherein the clip provides resilient clamping onto the shelf, the clip having an arcuate portion that causes the at least one panel to resiliently flex against the shelf.

8. The retail display apparatus of claim 7, wherein the clip clamps the shelf between the clip, the at least one panel, and a bottom surface of the label holder.

9. The retail display apparatus of claim 1, wherein a label is confined between the at least one panel and the front angled panel.

10. The retail display apparatus of claim 1, wherein the label holder terminates below the top panel and is not secured to the top panel.

11. The retail display apparatus of claim 10, wherein the rib engages and biases against the front flat surface.

12. A retail display apparatus comprising in combination:

(a) a shelf comprising:

a top panel extending horizontally;

a front angled panel having a flat front surface extending downwardly and forwardly from the top panel; and a lower support flange extending horizontally rearwardly from the front angled panel in vertical spaced relation to the top panel;

(b) a label holder formed of resilient plastic material, the label holder comprising:

at least one panel; and a retainer structure integrally connected to the at least one panel, the retainer structure including a bottom flange extending rearwardly relative to the at least one panel, the bottom flange carrying a clip;

wherein the label holder has a first relaxed state when the label holder is not mounted to the shelf and a second biased state when the label holder is mounted to the shelf, the at least one panel being deformed in biased relation against the flat front surface in the second biased state to thereby secure, in cooperation with the clip, the label holder to the shelf in the second biased state, and wherein the at least one panel is flexed forwardly relative to the bottom flange in the second biased state as opposed to the first relaxed state; and wherein a rear surface of the at least one panel includes a rib, the rib disposed proximate a distal end of the at least one panel and extending along a length of the rear surface, wherein the rib of the at least one panel assists in deforming the at least one panel and engages and biases against the front flat surface.

13. The retail display apparatus of claim 12, wherein the label holder terminates below the top panel and is not secured to the top panel.

14. The retail display apparatus of claim 12, wherein the at least one panel includes a front panel and a back panel adapted to hold a label therebetween.

15. A retail display apparatus comprising in combination:

(a) a shelf comprising:

a top panel extending horizontally;

a front angled panel having a flat front surface extending downwardly and forwardly from the top panel; and a lower support flange extending horizontally rearwardly from the front angled panel in vertical spaced relation to the top panel;

(b) a label holder formed of resilient plastic material, the label holder comprising:

at least one panel; and a retainer structure integrally connected to the at least one panel, the retainer structure including a bottom flange extending rearwardly relative to the at least one panel, the bottom flange carrying a clip;

wherein the label holder has a first relaxed state when the label holder is not mounted to the shelf and a second biased state when the label holder is mounted to the shelf, the at least one panel defining a curved surface extending through a middle portion of the at least one panel between top and bottom portions thereof when in the first relaxed state, the at least one panel being deformed in biased relation against the flat front surface in the second biased state to thereby secure, in cooperation with the clip, the label holder to the shelf in the second biased state, and wherein the at least one panel is flexed forwardly relative to the bottom flange in the second biased state as opposed to the first relaxed state; and wherein a label is located between the at least one panel and the front angled panel.

16. The retail display apparatus of claim 15, wherein the label holder terminates below the top panel and is not secured to the top panel.

17. A label holder for a retail display apparatus including a shelf having a top panel extending horizontally, a front angled panel having a flat front surface extending downwardly and forwardly from the top panel, and a lower support flange extending horizontally rearwardly from the front angled panel in vertical spaced relation to the top panel and forming at a first angle, the label holder comprising:

at least one panel formed of plastic material;

a retainer structure integrally connected to the at least one panel, the retainer structure including a bottom flange extending rearwardly relative to the at least one panel and configured to extend along the lower support flange, the bottom flange carrying a clip adapted to engage the shelf; and means integral with the at least one panel for resiliently deforming the at least one panel when engaged with the flat front surface of the front angled panel and for securing the label holder to the shelf in cooperation with the retainer clip; and wherein a rear surface of the at least one panel includes a rib, the rib disposed proximate a distal end of the at least one panel and extending along a length of the rear surface, wherein the rib of the at least one panel assists in deforming the at least one panel and engages and biases against the front flat surface.

18. The label holder of claim 17, wherein said means is unitary with and formed into the at least one panel.

* * * * *